US010244847B2

(12) United States Patent
Wilson et al.

(10) Patent No.: US 10,244,847 B2
(45) Date of Patent: Apr. 2, 2019

(54) COSMETIC APPLICATOR WITH ALIGNING CAP

(71) Applicant: HCT GROUP HOLDINGS LIMITED, Central (CN)

(72) Inventors: Jeremy Wilson, Los Angeles, CA (US); Armando Villarreal, Los Angeles, CA (US); Adrian Apodaca, Daly City, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 15/453,624

(22) Filed: Mar. 8, 2017

(65) Prior Publication Data

US 2017/0265627 A1 Sep. 21, 2017

Related U.S. Application Data

(60) Provisional application No. 62/308,921, filed on Mar. 16, 2016.

(51) Int. Cl.

| | |
|---|---|
| ***A45D 34/04*** | (2006.01) |
| ***A45D 40/26*** | (2006.01) |
| ***B65D 51/32*** | (2006.01) |
| *A45D 40/00* | (2006.01) |
| *A45D 34/00* | (2006.01) |

(52) U.S. Cl.

CPC ..... *A45D 40/267* (2013.01); *B65D 51/32* (2013.01); *A45D 34/00* (2013.01); *A45D 40/265* (2013.01); *A45D 2040/0012* (2013.01)

(58) Field of Classification Search

USPC ..... 215/224

See application file for complete search history.

(56) References Cited

U.S. PATENT DOCUMENTS

| | | | |
|---|---|---|---|
| D35,976 | S | 7/1902 | McCormick |
| D164,327 | S | 8/1951 | Roehrich |
| D165,691 | S | 1/1952 | Macomic |
| D197,192 | S | 12/1963 | Lorenzen |
| 3,337,901 | A | 8/1967 | Schefer et al. |
| 3,342,379 | A | 9/1967 | Foley |
| D209,098 | S | 10/1967 | Spiess |
| D215,083 | S | 9/1969 | Carter |
| D230,137 | S | 1/1974 | Bettonica |
| D234,394 | S | 2/1975 | Metzgcr |
| D237,926 | S | 12/1975 | Katzander |
| 3,951,157 | A | 4/1976 | Idec |
| D241,120 | S | 8/1976 | Dekker |
| D245,398 | S | 8/1977 | Grodin |
| D253,396 | S | 11/1979 | Hasegawa et al. |

(Continued)

*Primary Examiner* — David Walczak
*Assistant Examiner* — Joshua Wiljanen
(74) *Attorney, Agent, or Firm* — Seager, Tufte & Wickhem LLP

(57) ABSTRACT

A cosmetic packaging device with aligning cap includes connection structures and/or a collar that facilitate easy alignment of the cap/applicator to the cosmetics packaging in order to achieve a desirable appearance in an easy manner to the user. Ramped edges on one or both of the collar on a bottle and/or a connecting structure of an applicator are designed to guide a tab into a slot as the applicator and cap are replaced on the cosmetics packaging, which may contain a cosmetic product such as a mascara, lip gloss or various other products.

10 Claims, 11 Drawing Sheets

(56) References Cited

U.S. PATENT DOCUMENTS

D253,458 S 11/1979 Hasegawa et al.
D253,459 S 11/1979 Hasegawa et al.
4,273,248 A 6/1981 Lehmann
D268,097 S 3/1983 Thompson
D269,067 S 5/1983 Ballereaud
4,500,016 A * 2/1985 Funfstuck ..... B65D 47/265 222/153.14
D280,135 S 8/1985 Cassai et al.
D281,281 S 11/1985 Matalon
D293,834 S 1/1988 White et al.
D293,944 S 1/1988 Trabattoni
D301,771 S 6/1989 Bakic
D303,927 S 10/1989 Weber
D317,407 S 6/1991 Gray et al.
D324,994 S 3/1992 Jentgen
5,116,154 A 5/1992 Fulkerson
D350,836 S 9/1994 Chevassus
D353,100 S 12/1994 Mandel
D353,101 S 12/1994 Desgrippes
D355,363 S 2/1995 Iorii et al.
D361,159 S 8/1995 Feng
D373,730 S 9/1996 Baron
D386,972 S 12/1997 Stoecker
D389,064 S 1/1998 Sethi et al.
D405,013 S 2/1999 Schaeffer
D406,921 S 3/1999 Roeder
D411,749 S 6/1999 Nahum-Albright
D416,491 S 11/1999 Gobe
D417,752 S 12/1999 Bakic
D418,253 S 12/1999 Bakic
6,010,264 A 1/2000 Scuderi et al.
6,035,865 A 3/2000 Krieger
D422,916 S 4/2000 Herrmann
D424,115 S 5/2000 Kuboshima
D425,669 S 5/2000 Gavin
6,062,757 A 5/2000 Gueret
D432,224 S 10/2000 Hautmann et al.
D432,724 S 10/2000 Gavin
D442,868 S 5/2001 Gavin
D447,694 S 9/2001 Leggett
6,287,034 B1 9/2001 Miraglia et al.
6,290,416 B1 9/2001 Gueret
6,315,479 B1 11/2001 Sakurai
D463,262 S 9/2002 Gobe
D470,415 S 2/2003 Weber
D471,108 S 3/2003 Calderone, Jr.
D474,341 S 5/2003 Cantone et al.
D481,319 S 10/2003 Orsomando
D482,284 S 11/2003 Cantone et al.
6,669,389 B2 12/2003 Gueret
D487,703 S 3/2004 Orsomando
6,789,970 B1 9/2004 Shearon et al.
D498,422 S 11/2004 Theunynck
6,866,046 B2 3/2005 Gueret
6,872,020 B2 3/2005 Epli
6,942,412 B2 9/2005 Gueret
D527,180 S 8/2006 Raile
7,083,347 B2 8/2006 Marcotte et al.
7,108,441 B2 9/2006 Altonen et al.
D529,292 S 10/2006 Langer
D532,637 S 11/2006 Bassett et al.
D532,936 S 11/2006 Bakic
D533,074 S 12/2006 Mongeon et al.
D533,309 S 12/2006 Nobuto et al.
D535,104 S 1/2007 Chen
D535,441 S 1/2007 Maddy
D538,480 S 3/2007 Chen
D539,153 S 3/2007 Marx et al.
D541,169 S 4/2007 Ball et al.
D541,990 S 5/2007 Hsu
7,237,973 B1 7/2007 Lou
D551,569 S 9/2007 Tanaka
D551,987 S 10/2007 Kuethe et al.
D553,355 S 10/2007 Mosteller
D554,291 S 10/2007 Darnell et al.
D555,507 S 11/2007 Presche
D570,545 S 6/2008 Althoff et al.
D572,476 S 7/2008 Raile
7,419,323 B1 9/2008 Zhang
D594,320 S 6/2009 Tanaka et al.
7,614,404 B2 11/2009 Kee
D616,608 S 5/2010 Maddy
D617,050 S 6/2010 Lou
D620,807 S 8/2010 Wang Treadway et al.
D620,808 S 8/2010 Gieux
D623,949 S 9/2010 Throndsen
D626,005 S 10/2010 Duquet
D632,014 S 2/2011 Lee
D633,653 S 3/2011 Lee
D637,910 S 5/2011 Yeung
D638,710 S 5/2011 Yeung
D639,664 S 6/2011 Thorpe et al.
D643,294 S 8/2011 Thorpe et al.
7,996,947 B2 8/2011 Gueret
D654,375 S 2/2012 Kuboshima
D656,824 S 4/2012 Haile
D663,483 S 7/2012 Lee
D678,074 S 3/2013 De France
D679,604 S 4/2013 Sung
D685,637 S 7/2013 Colon et al.
D691,889 S 10/2013 Mettler et al.
D704,066 S 5/2014 de Lima Paschoal et al.
D705,074 S 5/2014 Della Valle
D705,663 S 5/2014 Guichot
8,714,857 B1 5/2014 Liu
D710,211 S 8/2014 Behar et al.
D714,157 S 9/2014 Albertini
D715,653 S 10/2014 Lavigne et al.
D716,148 S 10/2014 DeMarco et al.
D743,101 S 11/2015 Pires et al.
2007/0116509 A1 5/2007 Lin
2007/0151571 A1 7/2007 Byun
2007/0205233 A1 9/2007 Petit et al.
2010/0028070 A1 2/2010 Gieux et al.
2011/0176854 A1 7/2011 Nobles
2011/0250008 A1 10/2011 Lim
2012/0177432 A1* 7/2012 Vanoncini ..... A45D 34/045 401/140
2013/0343798 A1 12/2013 Delage et al.
2013/0343800 A1 12/2013 Drugeon et al.

* cited by examiner

COSMETIC APPLICATOR WITH ALIGNING CAP

CROSS REFERENCE TO RELATED APPLICATIONS

The present application claims the benefit of and priority to U.S. Provisional Patent Application Ser. No. 62/308,921, filed Mar. 16, 2016, titled COSMETIC APPLICATOR WITH ALIGNING CAP, the disclosure of which is incorporated herein by reference.

TECHNOLOGY FIELD

The present application relates generally to a cosmetic applicator having an outer shell, a bottle, and a cap, the cap being coupled to an applicator for dipping into the bottle. More particularly, the present application illustrates a design for the cap and a collar for receiving the cap that allows easy self-alignment.

BACKGROUND

Various cosmetics can be provided in a bottle designed for access with an elongated wand having and applicator on the end thereof. For example, a wand may have a doe foot applicator tip, a sponge applicator tip, or a brush applicator tip (such as mascara, eyeliner or nail polish). The wand may be attached to a cap that double as a handle during application of cosmetic product.

Cosmetic packaging is often designed for is aesthetic appeal as well as its functional capabilities. A number of existing designs are well known, such as screw-on and snap closures. If a symmetric look and/or closure is desired, both screw-on and snap closures may present undesirable outcomes. New and alternative designs, providing secure closure and retaining an aesthetic look, are desired.

SUMMARY

In an illustrative example, a cosmetic packaging device with aligning cap includes connection structures and/or a collar that facilitate easy alignment of the cap/applicator to the cosmetics packaging in order to achieve a desirable appearance in an easy manner to the user. Ramped edges on one or both of the collar on a bottle and/or a connecting structure of an applicator are designed to guide a tab into a slot as the applicator and cap are replaced on the cosmetics packaging, which may contain a cosmetic product such as a mascara, lip gloss or various other products.

A first non-limiting example takes the form of a combination cosmetic bottle and cap comprising: a cosmetic bottle defining a reservoir for containing a cosmetic product and having an open end with a collar configured for engagement with the cap, wherein the collar comprises a first ramped edge extending around less than the full perimeter thereof having an upper end and a lower end, the lower end adjacent to a slot; a cap coupled to an applicator, with a connecting structure therebetween having at least a tab thereon for aligning the cap with the collar; wherein the tab is configured for sliding engagement against the ramped edge of the collar and to fit within the slot to secure the cap in a desired alignment with the collar.

A second non-limiting example takes the form of a combination cosmetic bottle and cap as in the first non-limiting example, further comprising a click feature having a first part on the collar and a second part on the connecting structure, and configured click upon full insertion of the tab into the slot to secure the cap to the bottle.

A third non-limiting example takes the form of a combination cosmetic bottle and cap as in the first non-limiting example, wherein the collar comprises a second ramped edge extending around less than the full perimeter thereof, the second ramped edge having an upper end and a lower end, the lower end adjacent to the slot.

A fourth non-limiting example takes the form of a combination cosmetic bottle and cap as in the third non-limiting example, wherein the first and second ramped edges extend about first and second arcs, respectively, the first and second arcs each occupying an angle in the range of about 90 to about 170 degrees relative to a central axis of the collar.

A fifth non-limiting example takes the form of a combination cosmetic bottle and cap as in the third non-limiting example, wherein the first and second ramped edges are approximately symmetrical about the gap.

A sixth non-limiting example takes the form of a combination cosmetic bottle and cap as in the third non-limiting example, wherein the first and second ramped edges have an angle, relative to a transverse plane of the collar, in the range of about 30 to about 75 degrees.

A seventh non-limiting example takes the form of a combination cosmetic bottle and cap as in the third non-limiting example, wherein the first and second ramped edges have an angle, relative to a transverse plane of the collar, in the range of about 60 degrees.

An eighth non-limiting example takes the form of a combination cosmetic bottle and cap as in the third non-limiting example, wherein the connecting structure comprises third and fourth ramped edges at angles relative to the transverse plane of the connecting structure that match corresponding angles of the first and second ramped edges, the third and fourth ramped edges each having first ends at the tab.

A ninth non-limiting example takes the form of a combination cosmetic bottle and cap as in the first non-limiting example, wherein the slot extends in the range of about 10 to about 30 degrees relative to the central axis of the collar.

A tenth non-limiting example takes the form of a combination cosmetic bottle and cap as in any of the first to ninth non-limiting examples, wherein the bottle further comprises an outer shell which covers at least the slot and the first ramped edge. An eleventh non-limiting example takes the form of a combination cosmetic bottle and cap as in the tenth non-limiting example, wherein the cap comprises a decorative top, and the outer shell comprises an upper edge, wherein the desired alignment is such that that decorative top and upper edge are parallel to one another.

A twelfth non-limiting example takes the form of a combination cosmetic bottle and cap as in any of the first to ninth non-limiting examples, wherein the collar further comprises a wiper affixed thereto.

A thirteenth non-limiting example takes the form of a cosmetic bottle for use with a cap, the bottle comprising: a reservoir for containing a cosmetic product and having an open end; and a collar configured for engagement with the cap secured to the open end of the reservoir; wherein the collar comprises a first ramped edge extending around less than the full perimeter thereof having an upper end and a lower end, the lower end adjacent to a slot.

A fourteenth non-limiting example takes the form of a cosmetic applicator and cap for use with a bottle, the applicator and cap comprising: an applicator for applying a cosmetic product; a decorative cap; and an engagement structure for engaging and securing to a bottle, the engagement structure comprising a tab and first and second ramped edges extending therefrom, the tab extending axially toward the applicator relative to the cap, and the first and second ramped edges extending axially from the tab toward the cap.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
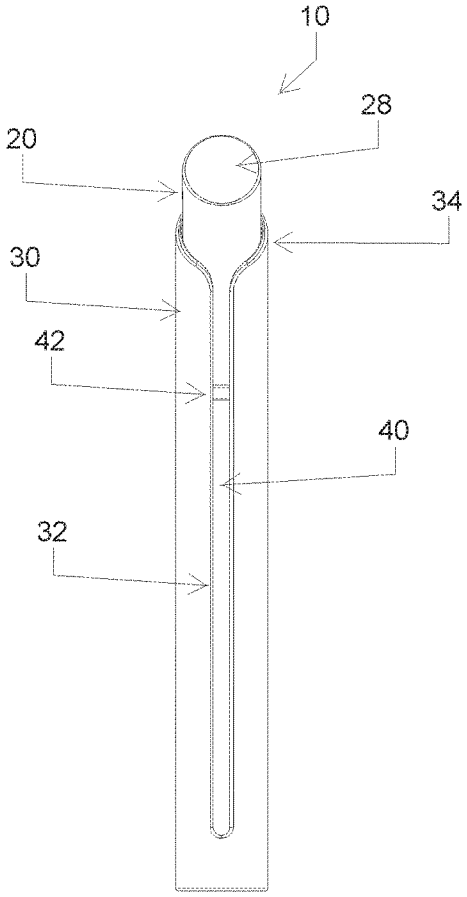
FIG. 1 is a perspective view of a cosmetic packaging with aligning cap.

FIG. 1 is a perspective view of a cosmetic packing with aligning cap. In particular, the device 10 comprises an applicator 20 having a decorative cap 28 that includes a connecting structure (not shown) and a wand with a cosmetic applicator (not shown). The device 10 also comprises an outer shell 30 with a slot 32 and upper edge 34 for decorative purposes. In this example, the upper edge 34 and decorative cap 28 provide a desirable appearance by having angled upper ends that parallel one another when the applicator is fully stowed, as shown. To achieve the desirable appearance, however, the applicator 20 and decorative cap 28 must align appropriately with the shell 30. To ensure desired alignment, the bottle 40 includes a collar indicated at 42, the details of which are more fully explained below.

The shell 30 may be opaque, semi-transparent or transparent, as desired. In one example, the shell is opaque so as to conceal details of the collar 42 and its connection to the cap 20 to provide a clean aesthetic. Any suitable materials, such as metals, plastics, glass, wood, ceramic, stone, leather, fabric, etc., may be used throughout the device 10.

Figure 2:
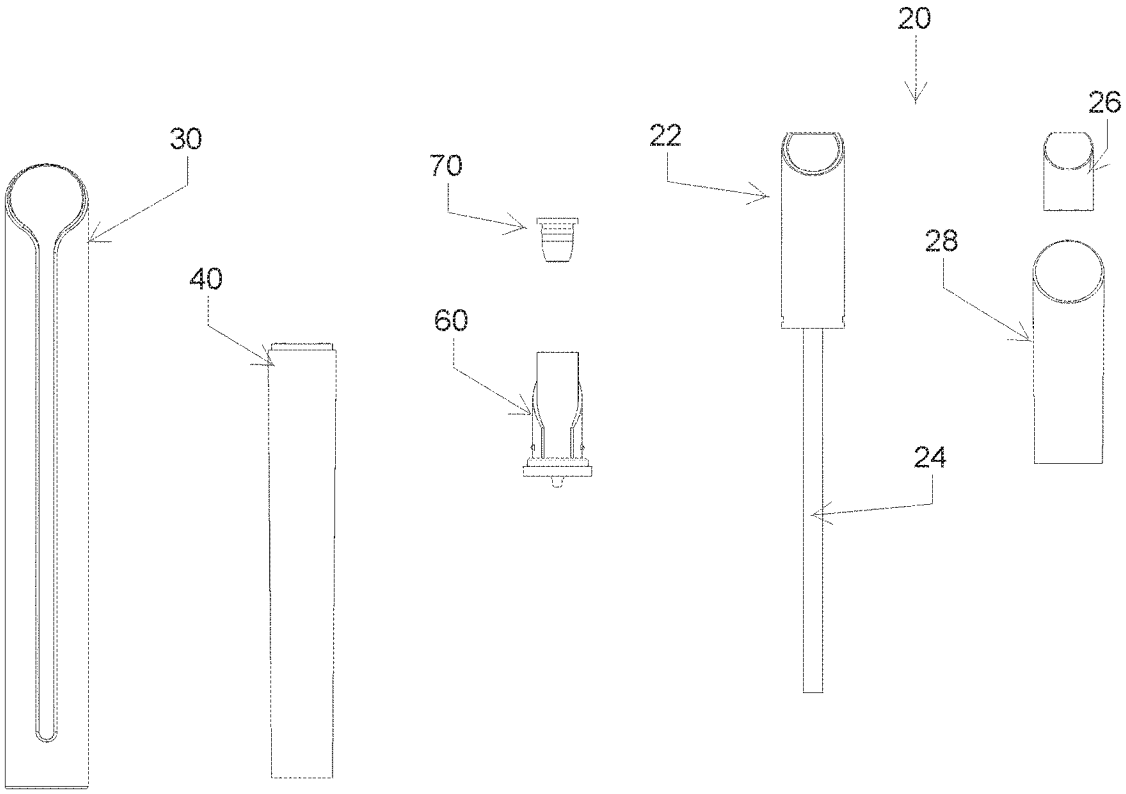
FIG. 2 is an exploded view of the elements of FIG. 1.

FIG. 2 is an exploded view of the elements of FIG. 1. As can be seen, the applicator 20 comprises a combination of stem 24 and connection structure 22, including a weight 26, over which a decorative cap 28 goes. The shell 30 is a separate piece, and is sized to hold the bottle 40. A collar 60 is designed to attach over the bottle 40. A conventional wiper 70 can be placed inside the collar 70 to secure it to the top of the bottle 40. The bottle is designed to contain a cosmetic product, which can be, for example, without limitation, mascara, lip gloss, eye liner, concealer, eye primer, lash primer, lip stain, nail polish, polish remover, and other products applied via brushes, sponges, plastic tips, metal tips, ceramic tips, stone tips, or other cosmetic applicators.

Figure 3:
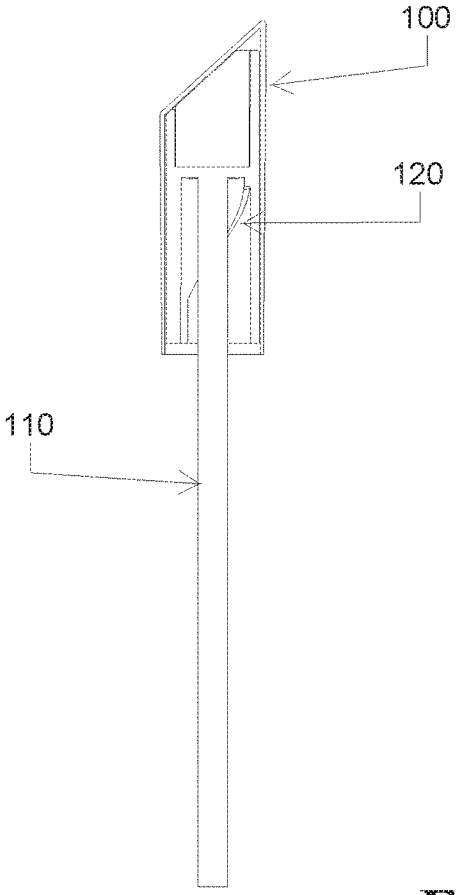
FIG. 3 is a section view of an illustrative applicator.

FIG. 3 is a section view of an applicator. The applicator can be seen as including the connection structure 100 coupled to a wand 110, the end of which may include a cosmetic applicator such as a brush, sponge or the like. In the section view it can be seen that the connection structure 100 includes a ramped edge 120 that is used for ensuring alignment of the applicator to the bottle as further detailed below.

Figure 4:
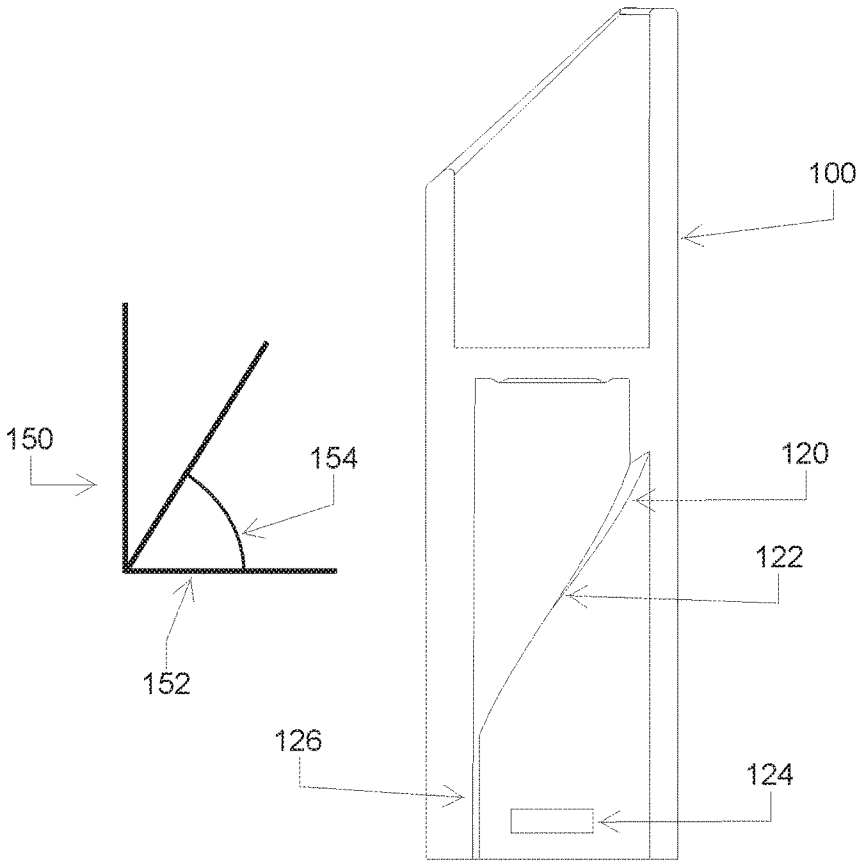
FIG. 4 is a section view focusing on an illustrative applicator cap.

FIG. 4 is a section view focusing on an illustrative applicator cap. The connection structure 100 is shown as well as the ramped edge 120, which has a face 122 directed down toward the bottom of the image shown. In addition, the connection structure 100 includes a tab shown in section view at 126, which will be better understood in FIG. 5, below. An opening or indentation is shown at 124, and is configured to cooperate with a corresponding protrusion in the collar shown in FIGS. 7-9, below, to provide a snap fit. In this instance element 124 is a through-opening, though an indentation may be used instead.

As shown at 150, the ramped edge 120 defines an angle 154 which for purposes of this description is relative to the transverse plane 152 of the connecting structure 100. In this example, the angle 154 is about 60 degrees relative to the transverse plane. The angle 154 may be in the range of about 30 to about 75 degrees, or more or less, as desired. A steeper angle may require somewhat more axial length to be available, but will likely yield an easier closure, while a shallower angle will require less space but may not provide as easy or smooth feel to the user. Such factors may be considered when choosing a particular design.

Figure 5:
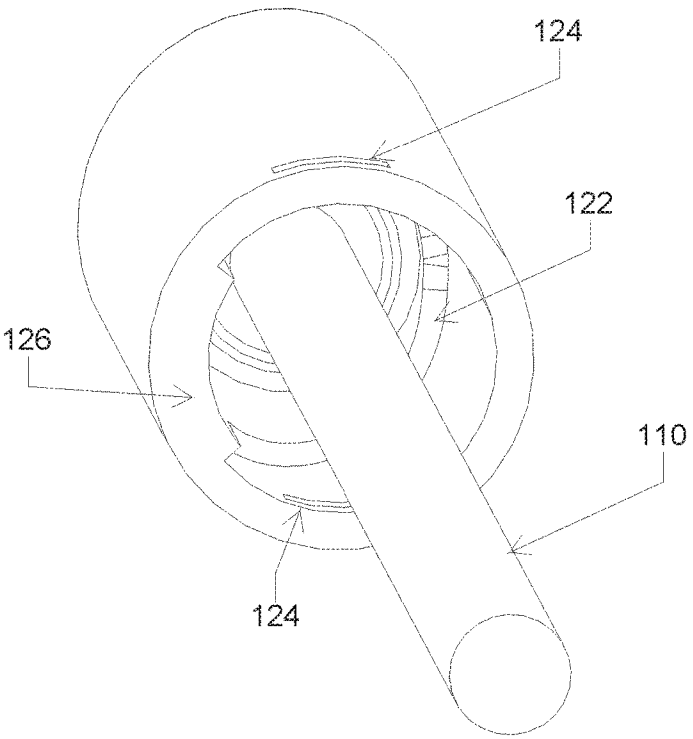
FIG. 5 is a bottom perspective view of an illustrative applicator.

FIG. 5 is a bottom perspective view of an illustrative applicator. In the perspective view, it can be seen that the stem 110 extends down from the connecting structure. The connecting structure 120 is shown with the tab 126 made more apparent here. The ramped edge 122 can be seen to extend about a portion of the circumference of the connecting structure. The indentation or opening 124 can also be observed.

The overall piece may be, for example, insert molded onto the stem 110. If desired a grinding or removal process may be used instead, such that the connecting structure may begin as a simple tubular member, and the ramped edges and tab may be defined by selective removal of material by, for example, grinding. Other manufacturing methods may be used instead.

Figure 6:
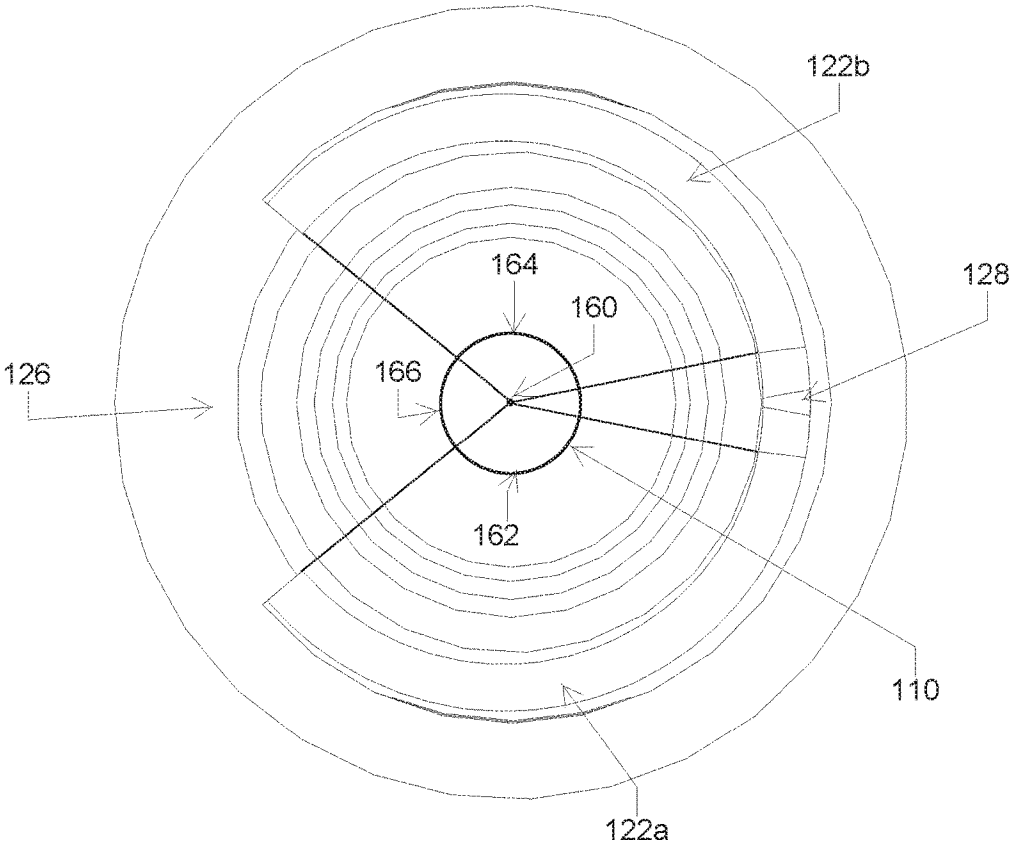
FIG. 6 is an elevation view from below of an illustrative applicator.

FIG. 6 is an elevation view from below of an illustrative applicator. The stem is shown at 110, and the elements used for alignment are shown including the tab at 126, a first ramped edge 122*a*, and a second ramped edge 122*b*. A gap 128 may optionally be provided between the first and second ramped edges 122*a*, 122*b*. Other examples may simply have the two ramped edges 122*a*, 122*b* meet rather than including a gap 128. The two ramped edges 122*a*, 122*b* each abut the tab 126.

A central axis 160 is defined for the illustrative applicator. In the example shown, each of the ramped edges 122*a*, 122*b*, occupies an angle (162, 164, respectively) relative to the central axis of about 130 degrees, a bit more than ⅓ of the circumference. In other examples, the ramped edges 122*a*, 122*b* may occupy, for example, in the range of about 90 to about 160 degrees, or more or less, as desired. In this example, the tab occupies an angle 166 relative to the central axis of about 80 degrees, or a little less than ¼ of the circumference. In other examples, the tab may occupy an angle 166 in the range of about 30 to about 120 degrees, or more or less, as desired.

In some examples, the material chosen for the ramped edges 122*a*, 122*b* and tab 126 may be selected to be slippery by using, for example, a metal surface, or a hard plastic, and/or a coating may be applied. By providing a slippery surface, easy turning and insertion can be more readily provided.

Figure 7:
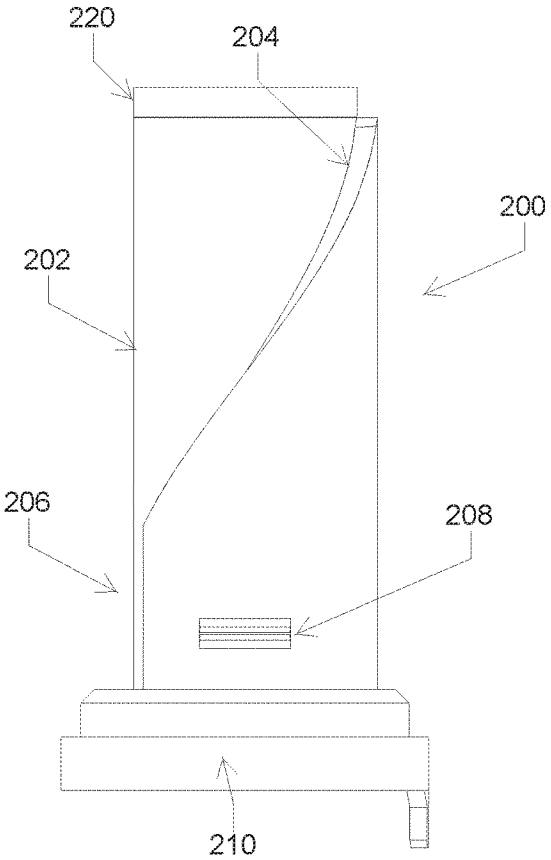
FIG. 7 is a side view of an illustrative collar.

FIG. 7 is a side view of an illustrative collar. The collar 200 includes a main tubular portion 202 on which a ramped edge 204 is provided. A slot 206 appears next to the end of the ramped edge 204. The collar 200 includes a snap fit protrusion 208 designed for engaging the snap fit opening or indentation 124 (FIG. 5).

At the base of the collar 200 is an overlay 210 designed to fit over the end of a bottle. A snap-fit may be used to secure the collar 200 to the bottle, if desired. The overlay 210 may instead be threaded for securing to the bottle (not shown). Any other suitable manner of securing the collar 200 to a bottle may be used instead.

A conventional wiper 220 may be placed and/or secured to the upper end of the collar 200. Such a wiper 220 is used to remove excess product from a cosmetic applicator as it is withdrawn from the bottle (not shown).

Figure 8:
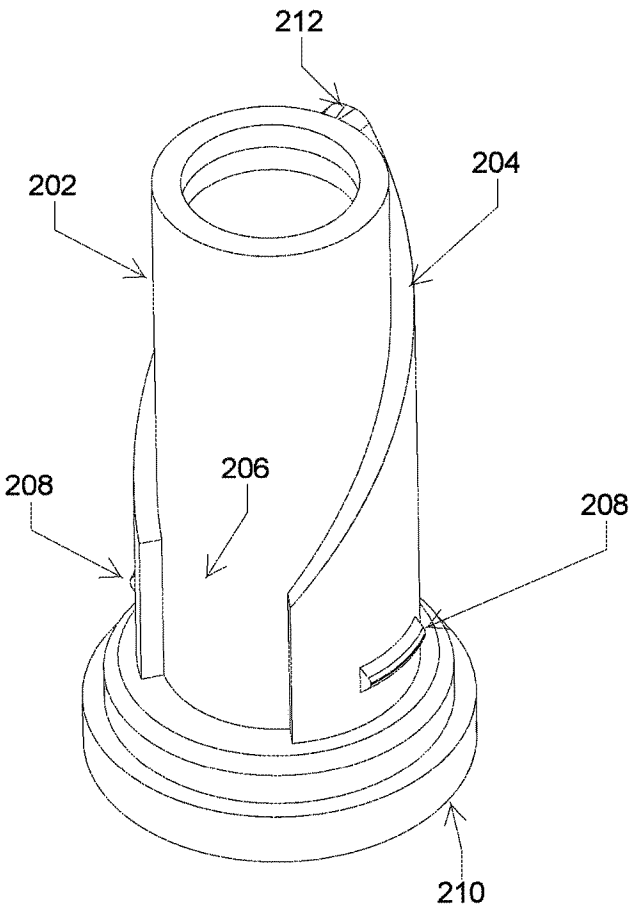
FIG. 8 is a perspective view of an illustrative collar.

FIG. 8 is a perspective view of an illustrative collar, this time rotated slightly relative to FIG. 7. The gap 206 is more fully visible at the termination of each of the ramped edges 204, which extend around the tubular portion 202 of the collar 200. It can also be seen that there are provided snap fit structures 208 on both sides of the collar 200. In other designs, 1, 2 or more snap fit structures may be placed about the circumference of the collar, with corresponding openings or indentations in the applicator, as desired.

At an upper edge, the ramped edges come together at a blunted region 212. The blunted region 212 may be omitted, but this may potentially leave a rather sharp edge and/or fragile edge, depending on the angles of the two ramped edges 204. For example, the ramped edges 204 may be placed at angles that match the ramped edges 122*a*, 122*b* of the applicator as illustrated at 150 in FIG. 4. Use of a blunted region 212 may reduce the likelihood of the structure chipping or breaking in use.

Figure 9:
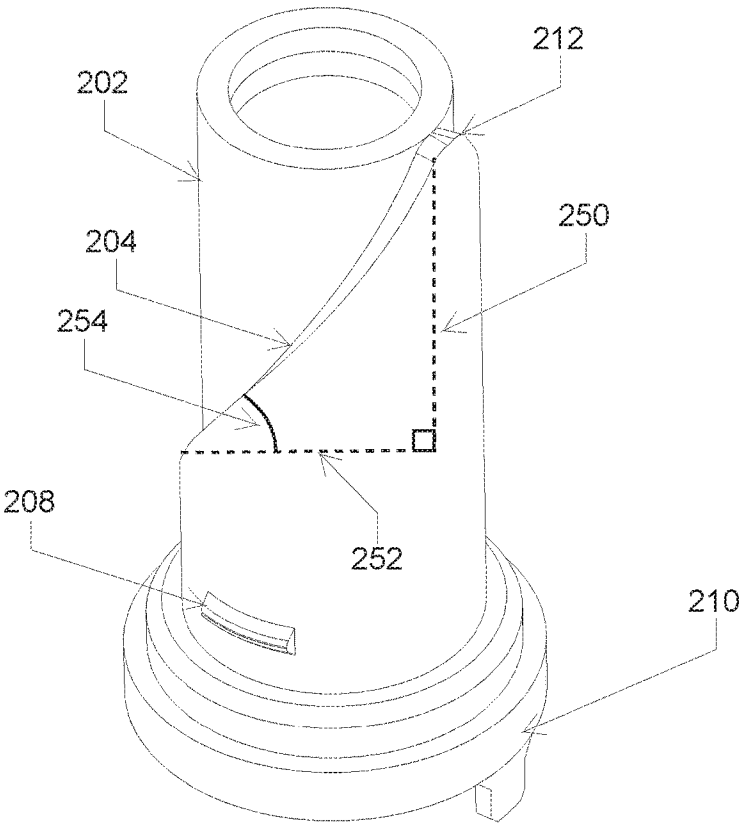
FIG. 9 is another perspective view of an illustrative collar.

FIG. 9 is another perspective view of an illustrative collar in order to illustrate the angle of the ramped edge 204. A line parallel to the axis of the collar 200 is shown at 250, defining a line on the transverse plane of the collar 200 shown at 252. The angle of the ramped edge 204 is noted at 254 and may be in the range of about 30 to about 75 degrees, with approximately 60 degrees shown in the illustrative example of FIG. 9.

It may be noted that the ramped edge 204 may slope (as may the ramped edges 122*a*, 122*b* of the applicator. For example, an initial angle 254 may be in the range of about 45 degrees, with the angle increasing along the ramped edge as one gets closer to the blunted region 212 to a maximum of about 75 degrees. In the example shown, the "average" angle 254 can be used as the point of measurement, with the average angle defined by calculating the arcsine of the length traversed along the axis 250 divided by the length of the face of the ramped edge. This yields approximately 60 degrees in the example shown.

Figure 10:
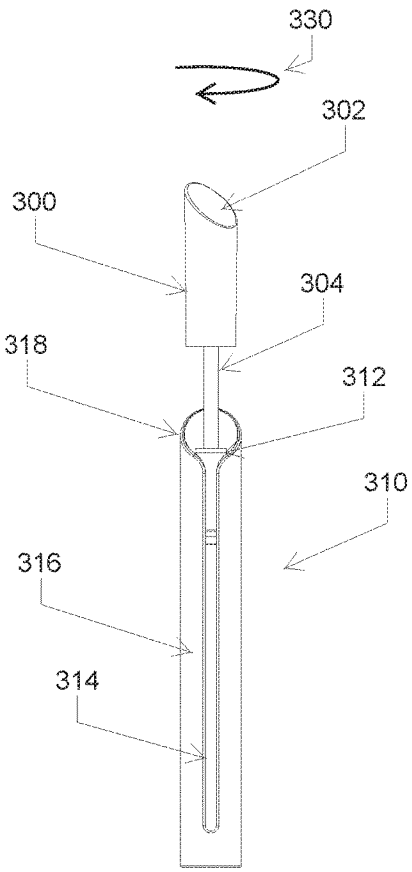
FIG. 10 shows insertion of an illustrative applicator to a cosmetic package.

FIG. 10 shows insertion of an illustrative applicator to a cosmetic package. As shown, the applicator 300 includes a decorative cap top side 302 having a slanted edge. The cosmetics package 310 includes a collar 312 substantially as shown above in FIGS. 7-9, secured to a bottle 314. A shell 316 is shown overlying the details of the collar 312 and having an upper edge 318 that is decoratively slanted in a manner that matches the cap top side 302. When closed, to provide the desired appearance, the cap top side 302 should align with the upper edge 318, generating a look as shown above in FIG. 1. Other decorative designs may be used instead; the idea is to provide a repeatable relative positioning between the applicator 300 and the cosmetic package 310.

As the applicator 300 is inserted into the collar 312, the ramped edge 204 (FIG. 7) designed to encourage the tab 126 (FIG. 5) to slide thereover toward the slot 206 (FIG. 7). The motion in this instance would twist in the direction as shown at 330. The tab 126 (FIG. 5) would then enter the slot 206 (FIG. 7). At this point, the cap top side 302 would be aligned with the upper edge 318 of the shell 316. The tab 126 (FIG. 5) is inserted into the slot 206 (FIG. 7) until the snap fit protrusion 208 (FIG. 7) engages the snap fit hole 124 (FIG. 5). If desired, an audible or tactile click may occur when the snap fit protrusion 208 (FIG. 7) engages the snap fit hole 124 (FIG. 5). As a result, of these structures, the desired appearance of the product when the applicator is stowed can be ensured.

In some examples, each of the applicator 300 and cosmetics package 310 include ramped edges to facilitate the guided insertion described for FIG. 10. In other embodiments, only one or the other of the applicator or cosmetics package has the ramped edges. For example, FIGS. 11-12 illustrate alternative collars and caps for self-alignment.

Figure 11:
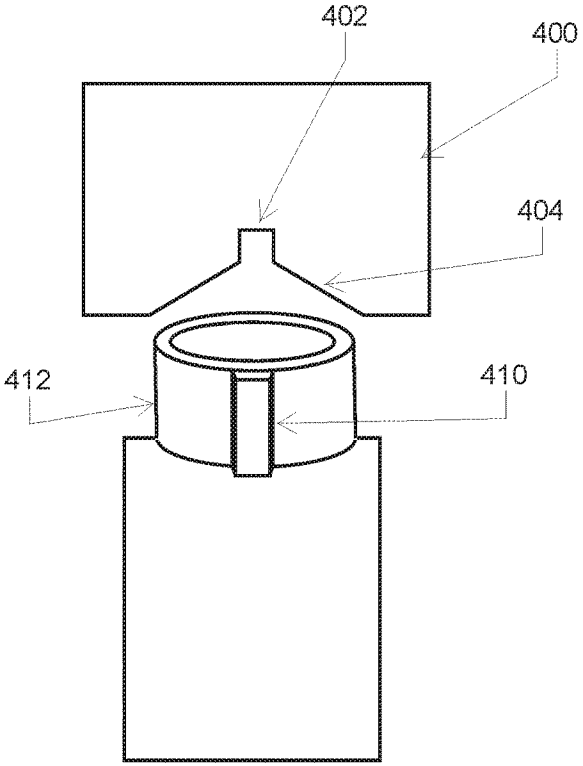

In FIG. 11, a portion of a connecting structure for an applicator is shown in side or section view at 400, and includes a slot 402 to receive a tab 410 on a collar 412. A pair of ramped edges 404 surround the slot 402 to guide the tab 410 to the desired position before allowing passage into the slot 402. If desired, snap fit structures such as a protrusion and opening or indentation as shown above may be provided as well.

Figure 12:
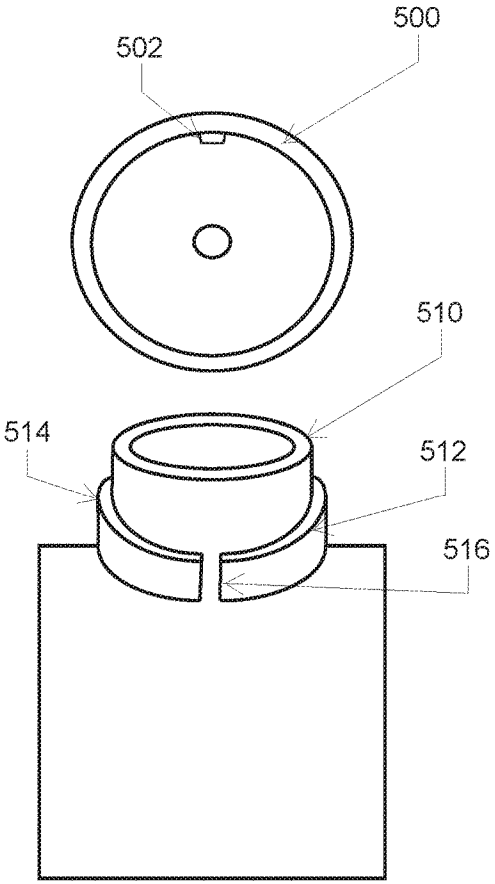
FIGS. 11-12 illustrate alternative collars and caps for self-alignment.

In FIG. 12, a portion of a connecting structure for an applicator is shown in an end view at 500, with a tab at 502. A collar 510 includes ramped edges 512, 514 that direct the tab 502 to a slot 516. Again, snap fit structures may be provided as well.

Thus as shown by FIGS. 11 and 12, the ramped edges may be provided on only one of the two structures. In these examples, it may be noted that the ramped edges are associated with a slot on one of the applicator or collar, while the tab is on the other of the applicator or collar.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects. The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A combination cosmetic bottle and cap comprising:

a cosmetic bottle defining a reservoir for containing a cosmetic product and having an open end with a collar configured for engagement with the cap, wherein the collar comprises a first ramped edge and a second ramped edge each extending around less than the full perimeter thereof, each having an upper end and a lower end, the lower ends thereof each adjacent to a slot;

a cap coupled to an applicator, with a connecting structure therebetween having at least a tab thereon for aligning the cap with the collar;

wherein the tab is configured for sliding engagement against the ramped edge of the collar and to fit within the slot to removably and replaceably secure the cap in a desired alignment with the collar, further comprising a click feature having a protrusion on the collar and an indentation on the connecting structure, and configured to click upon full insertion of the tab into the slot to secure the cap to the bottle, wherein upon full insertion of the tab into the slot to secure the cap to the bottle, the protrusion and the indentation form a snap fit;

wherein the first and second ramped edges extend about first and second arcs, respectively, the first and second arcs each spanning an arc in the range of about 90 to about 170 degrees relative to a central axis of the collar.

2. The combination cosmetic bottle and cap of claim 1, wherein the first and second ramped edges are approximately symmetrical about the gap.

3. The combination cosmetic bottle and cap of claim 1, wherein the first and second ramped edges have an angle, relative to a transverse plane of the collar, in the range of about 30 to about 75 degrees.

4. The combination cosmetic bottle and cap of claim 1, wherein the first and second ramped edges have an angle, relative to a transverse plane of the collar, in the range of about 60 degrees.

5. The combination cosmetic bottle and cap of claim 1, wherein the connecting structure comprises third and fourth ramped edges at angles relative to the transverse plane of the connecting structure that match corresponding angles of the first and second ramped edges, the third and fourth ramped edges each having first ends at the tab.

6. The combination cosmetic bottle and cap of claim 1 wherein the slot extends in the range of about 10 to about 30 degrees relative to the central axis of the collar.

7. The combination cosmetic bottle and cap of claim 1 wherein the bottle further comprises an outer shell which covers at least the slot and the first ramped edge.

8. The combination cosmetic bottle and cap of claim 7 wherein the cap comprises a decorative top, and the outer shell comprises an upper edge, wherein the desired alignment is such that that decorative top and upper edge are parallel to one another.

9. The combination cosmetic bottle and cap of claim 1 wherein the collar further comprises a wiper affixed thereto.

10. A cosmetic applicator and cap for use with a bottle, the applicator and cap comprising:

an applicator for applying a cosmetic product;

a decorative cap; and an engagement structure for engaging and securing to a bottle, the engagement structure comprising an indentation configured to releasably snap fit with a corresponding protrusion on the bottle, a tab and first and second ramped edges extending therefrom, the tab extending axially toward the applicator relative to the cap, and the first and second ramped edges extending axially from the tab toward the cap.

* * * * *